United States Patent [19]

Kakuta et al.

[11] Patent Number: 4,973,178

[45] Date of Patent: Nov. 27, 1990

[54] COSMETIC CASING CAPABLE OF PROTRUDING COSMETIC MATERIAL

[75] Inventors: Yoshiyuki Kakuta; Hiroshi Mizushima, both of Koto, Japan

[73] Assignee: Yoshino Kogyosyo Co., Ltd., Japan

[21] Appl. No.: 283,976

[22] Filed: Dec. 13, 1988

[51] Int. Cl.[5] ..... A45D 40/06; A45D 40/22

[52] U.S. Cl. ..... 401/59; 401/60

[58] Field of Search ..... 401/59, 60

[56] References Cited

U.S. PATENT DOCUMENTS

| | | | |
|---|---|---|---|
| 1,865,639 | 7/1932 | Most . | |
| 2,010,185 | 8/1935 | Garreau | 401/60 |
| 2,019,680 | 11/1935 | Kasdan et al. | 401/60 |
| 2,033,333 | 3/1936 | Fitz Gerald | 401/59 |
| 2,043,890 | 6/1936 | Florman | 401/60 |
| 2,104,364 | 1/1938 | Coryell | 401/59 |
| 2,443,361 | 6/1948 | Satz et al. . | |
| 2,514,969 | 7/1950 | Politzer | 401/59 |
| 2,644,577 | 7/1953 | Orenick . | |
| 2,663,414 | 12/1953 | Frylender | 401/60 |
| 3,737,241 | 6/1973 | Gordon et al. . | |

FOREIGN PATENT DOCUMENTS

| | | | |
|---|---|---|---|
| 601081 | 8/1934 | Fed. Rep. of Germany | 401/59 |
| 718572 | 1/1932 | France . | |
| 937723 | 8/1948 | France . | |
| 940313 | 12/1948 | France | 401/59 |
| 58-88914 | 6/1983 | Japan . | |
| 595666 | 10/1946 | United Kingdom | 401/59 |

*Primary Examiner*—Steven A. Bratlie
*Attorney, Agent, or Firm*—Oliff & Berridge

[57] ABSTRACT

A casing capable of opening a lid and protruding a cosmetic material contained in the casing by one operation, having a simple and improved overall appearance and capable of being reduced in size when the cosmetic material is retracted, the casing having: a tubular main body having an elongated aperture extending in the axial direction; a closer inner tube fitted in the tubular main body so that it can slide therein in the axial direction, the inner tube having an engaging projection projecting to the outside of the tubular main body through the elongated aperture; a screw tube rotatably fitted around the tubular main body, the screw tube having an inner screw groove in which the engaging projection of the inner tube is fitted so that the inner tube can be lifted as the screw tube rotates in one direction; a tubular member fitted around the screw tube so that the screw tube can rotate relative to the tubular member, the tubular member being fixed to the tubular main body; and a lid pivotally mounted for closing an opening of the tubular member while being urged by a spring in the direction of closing movement. When the inner tube is moved toward the opening of the tubular member by the rotation of the screw tube, the lid recedes toward the lower end of the casing so as to turn and open by contacting at its inner surface with an upper end portion of the casing.

1 Claim, 9 Drawing Sheets

COSMETIC CASING CAPABLE OF PROTRUDING COSMETIC MATERIAL

BACKGROUND OF THE INVENTION

This invention relates to a casing capable of protruding a cosmetic material such as lipstick contained in the casing.

Conventionally, an ordinary casing capable of putting out a cosmetic material such as lipstick contained therein has a structure wherein a stick of rouge is protruded from the body of the casing by a certain kind of protruding operation, e.g., rotation of a member on the casing body. It is convenient to design such an article so that the cap is automatically opened and closed in a linked relatioship with the protruding operation in order to eliminate the need for a separate operation of removing the cap.

In consideration of this point, the applicant of the present invention has proposed a stick-type cosmetic material casing which is disclosed in Japanese Utility Model Laid-Open No. 58-88914 and has a structure such as that shown in FIGS. 11 and 12.

This casing is constructed as described below. A lid 242 is attached to the upper end of a screw tube 214. The screw tube 214 has an inner helical groove 215 formed in its inner peripheral surface and an engaging projection 238 formed on the inner peripheral surface of its lower portion. A tubular body 201 is fitted in the screw tube 214. The tubular body 201 has an elongated aperture 202 extending in the axial direction and an outer helical groove 221 formed in the outer peripheral surface of its lower portion. The engaging projection 238 of the screw tube 214 is fitted in the outer helical groove 221. A closed inner tube 209 is fitted in the tubular body 201 while an engaging projection 210 formed on the inner tube 209 is fitted in the inner helical groove 215 of the screw tube 214 through the elongated aperture 202 of the tubular body 201. A tail tube 220 is fitted on and fixed to the outer peripheral surface of the rear end portion of the tubular body 201.

As the tubular body 201 is rotated by an operation of turning the tail tube 220 while supporting the screw tube 214, the screw tube 214 is moved downward by the cooperation of the outer helical groove 221 and the engaging projection 238 and the inner surface of the lid 242 is brought into contact with the upper end of the tubular body 201 whereby the lid 242 is turned and opened, as shown in FIG. 12. At the same time, the inner tube 209 is moved upward by the cooperation of the inner helical groove 215 and the engaging projection 210, thereby causing a lipstick 265 to project from the casing.

This conventional cosmetic material casing is useful because the rotary operation of the tubular body 201 moves both the lipstick 265 and the lid 242 so that the lipstick 265 projects from the casing as the lid 242 is opened.

However, in this type of casing, a hinge **242*a* which is provided at the top edge of the screw tube 214 and to which the lid 242 is attached must be positioned in such a manner that it protrudes outwardly beyond the top edge of the screw tube 214 in order to ensure that it does not obstruct the movement of the tubular body 201 and the inner tube 209. In addition to this protruberant structure of the hinge 242*a*, the tail tube 203** also creates a protrusion in relation to the overall shape of the casing. Thus, there is a problem of the appearance or the form of the casing being deteriorated contrary to the requirements for this kinds of cosmetic casing.

In the structure whereby the tail tube 220 is attached to the rear end of the screw tube 214, the inner and outer peripheral surfaces of these members repeatedly slide in contact with each other, and the appearance of the casing will be impaired by scratches formed by this sliding on the outer peripheral surface of the rear end portion of the screw tube 214.

In addition, since the outer helical groove 221 and the engaging projection 238 which cooperate to retract the screw tube 214 are provided in a lower portion of the tubular body 201 while the inner tube 209 is disposed above the outer helical groove 221, a large cavity formed below the inner tube 209 when the lipstick 365 is retracted, as shown in FIG. 11, resulting in an increase in the overall length of the casing.

SUMMARY OF THE INVENTION

In view of the above described facts, it is an object of the present invention to provide a casing for containing and protruding a cosmetic material capable of performing, in one action, the operation of opening the lid and protruding the cosmetic material, the casing having an improved, simple overall appearance, the overall size of the casing being reduced when the cosmetic material is retracted.

To this end, the present invention provides a casing having: a tubular main body having an elongated aperture extending in the axial direction; a closed inner tube fitted in the tubular main body so that it can slide therein in the axial direction, the inner tube having an engaging projection projecting to the outside of the tubular main body through the elongated aperture; a screw tube rotatably fitted around the tubular main body, the screw tube having an inner screw groove in which the engaging projection of the inner tube is fitted so that the inner tube can be lifted as the screw tube rotates in one direction; a tubular member fitted around the screw tube so that the screw tube can rotate relative to the tubular member, the tubular member being fixed to the tubular main body; and a lid pivotally mounted for closing an opening of the tubular member, the lid being urged in the direction of closing movement, wherein when the inner tube is moved toward the opening of the tubular member by the rotation of the screw tube, the lid recedes toward the lower end of the casing so as to turn and open by contacting at its inner surface with an upper end portion of the casing.

Receding of the lid relative to the screw tube means that at least one of the screw tube and the lid is moved. This operation is enabled by an arrangement wherein an engaging projection provided on the tubular member is fitted in a screw groove formed in the outer surface of the screw tube; and an engaging projection formed on the tubular main body is fitted in an elongated groove formed in the inner surface of the tubular member; the screw tube is capable of sliding together with the tubular main body to an extent corresponding to the length of the elongated groove in the tubular member; and the screw tube advances beyond the opening of the tubular member by rotating so as to open the lid and make the inner tube advance.

In another different arrangement, a longitudinal groove for sliding movement is formed in the tubular member, and a slidable plate is fitted in this longitudinal slide groove so that it can slide in the axial direction of the tubular member. An engaging projection formed on the slidable plate is fitted in an outer helical slit provided on the outside of the screw tube so that the slidable plate can be moved downward as the screw tube rotates in one direction. The lid for closing the opening of the tubular member is pivotally attached to an upper portion of the slidable plate while being urged by a spring in the direction of closing movement. The lid recedes relative to the screw tube by the downward movement of the slidable plate so that it turns in the direction of closing movement by contacting at its inner surface with an upper end portion of the casing

BRIEF DESCRIPTION OF THE DRAWINGS

FIG. 1 is a cross-sectional view of the whole of a casing which represents the first embodiment;

FIG. 2 is an exploded perspective view of the casing;

FIG. 3 is a development illustrating an inner screw groove and an inner horizontal groove formed in the inner surface of a screw tube;

FIG. 4 is a perspective view of a holder guide tube;

FIG. 5 is a cross-sectional view of an initial operation of opening the lid;

FIG. 6 is a cross-sectional view illustrating a state in which the cosmetic material is protruded;

FIG. 7 is a fragmentary sectional view of a casing which represents the second embodiment;

FIG. 8 is a fragmentary sectional view of the casing;

FIG. 9 is an exploded perspective view of the casing;

FIG. 10 is a perspective view of a state of the casing in which the lid is open;

DESCRIPTION OF THE PREFERRED EMBODIMENTS

Figure 1:
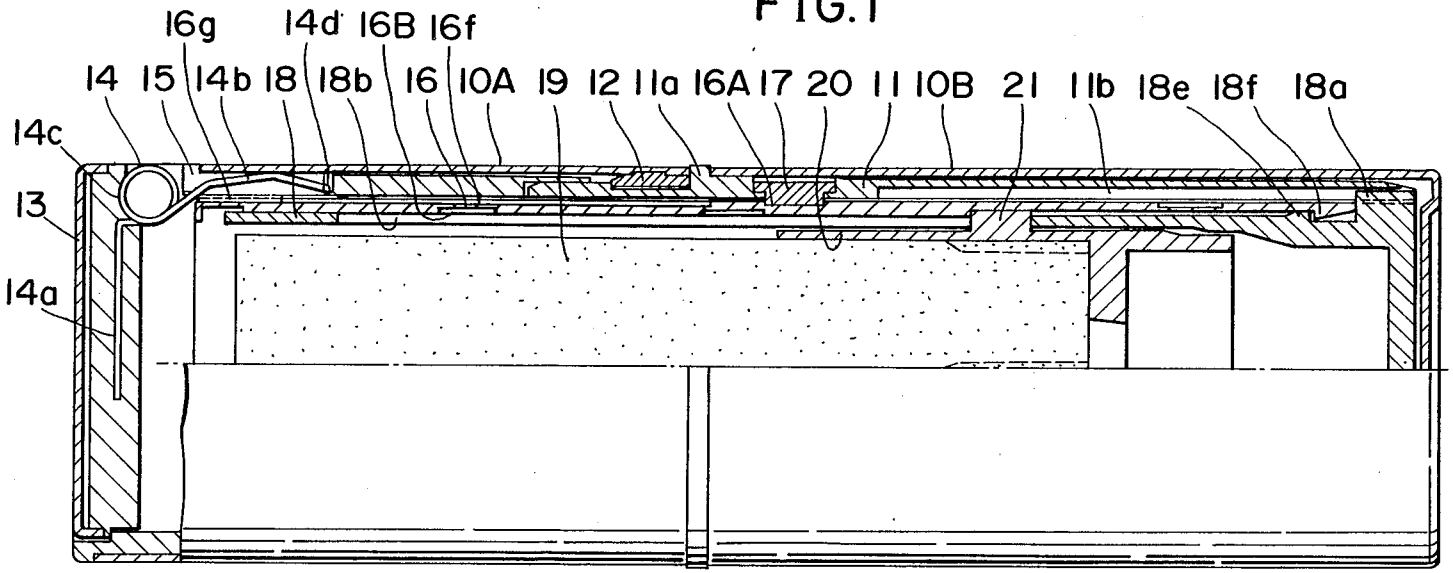
FIGS. 1 to 6 show a first embodiment of the present invention.

Examples of the structure of the invention (1) FIGS. 1 to 6 show a type of structure in accordance with the present invention in which the tubular body is advanced. In this example, the tubular member is illustrated as a guide tube 11, the tubular main body as a holder guide tube 18, the longitudinal elongated aperture as a longitudinal slit **18*b*(See FIGS. 1 and 4), the closed inner tube as a holder 20, the engaging projection as a second projection 21, and the inner helical groove as an inner screw groove 16B**.

That is, the longitudinal slit **18*b* is formed in the holder guide tube 18, the holder 20 is fitted in the holder guide tube 18 so that it can rotate in the longitudinal direction while the second projection provided on the holder 20 is projected to the outside of the holder guide tube 18. At the same time, a screw tube 16 is rotatably fitted around the holder guide tube 18, and the second projection 21 of the holder 20 is fitted in the internal screw groove 16B formed in the screw tube 16 so that the holder 20 can be lifted by an operation of rotating the screw tube 16 in one direction. The guide tube 11 which is fixed to the holder guide tube 18 is fitted around the screw tube 16 so that the screw tube 16 can rotate relative to the guide tube 11. A lid 13 for closing the opening of the guide tube 11 is pivotally mounted while being urged by a spring 14 in a direction such that it closes the opening. The arrangement is such that when the holder 20 is moved toward the opening of the guide tube 11 by the rotation of the screw tube 16, the screw tube 16 advances beyond the top end of the guide tube 11; and the lid 13 is moved in the direction of the lower end of the casing relative to the screw tube 16, the inner surface of the lid 13 contacting the top end of the screw tube 16 to turn and open the lid 13**.

This construction will be described below in further detail. This example of the casing has an outer rear tube 10B which is fitted on and fixed to the outer peripheral surface of a base end portion of the guide tube 11, and an outer head tube 10A which is rotatably fitted around the outer peripheral surface of a top portion of the guide tube 11.

The lid 13, urged by the spring 14 in the lid closing direction, is attached to the outer head tube 10A in the vicinity of the top opening edge thereof, and the screw tube 16 is fitted in the guide tube 11 so that it can slide on the inner peripheral surface of the guide tube in the axial direction and can rotate in the peripheral direction.

The screw tube 16 rotates integrally with the outer head tube 10A while sliding therein in the axial direction. An outer screw groove 16A is formed in the outer peripheral surface of the screw tube 16, and an outer horizontal groove 16C is formed in the outer peripheral surface of the base end portion of the screw tube 16 so as to connect to the outer screw groove 16A.

A first projection piece 17 is provided in the inner peripheral surface of the guide tube 11 so as to protrude beyond this surface. The first projection piece 17 is engaged with the outer screw groove 16A. The first projection piece 17 functions to advance the screw tube 16 in response to initial rotation of the outer rear tube 10B.

The inner screw groove 16B is formed in the inner peripheral surface of the screw tube 16, and an inner horizontal groove 16D is formed in the inner peripheral surface of the base end portion of the screw tube 16 so as to connect to the inner screw groove 16B.

The holder guide tube 18 is fitted on the inner peripheral surface of the screw tube 16 so that it can rotate in the peripheral direction but cannot move in the axial direction. The longitudinal slit **18*b* is formed in the holder guide tube 18** so as to extend in the axial direction thereof.

The holder guide tube 18 is capable of rotating integrally with the outer rear tube 10B. The holder 20 that supports a stick of cosmetic material 19, is slidably fitted on the inner peripheral surface of the holder guide tube 18. The second projection 21 formed on the outer peripheral surface of the holder 20 passes through the longitudinal slit **18*b* of the holder guide tube 18 and engages with the inner screw groove 16B of the screw tube 16**.

The holder guide tube 18 and the holder 20 are integrally rotated relative to the outer head tube 10A and the screw tube 16 by the initial rotation of the outer rear tube 10B. As the screw tube 16 thereby advances inside the guide tube 11, the top end of the screw tube 16 is brought into contact with the lid 13 and opens the same against the force of the spring 14.

During this operation, the second projection 21 of the holder 20 moves in the inner horizontal groove 16D in the inner surface of the screw tube 16 to the starting end of the inner screw groove 16B.

As the outer rear tube 10B further rotates after the initial rotation, the guide tube 11 and the holder guide tube 18 are thereby rotated integrally relative to the screw tube 16, and the holder 20 further moves forward to the advanced position, while being guided along the longitudinal slit **18*b* by the second projection 21 moving in the inner screw groove 16B, thereby urging the cosmetic material 19 out of the holder guide tube 18**.

During this operation, the first projection piece 17 exits out of the terminal end of the outer screw groove 16A and then moves in the outer horizontal groove 16C, thereby allowing the guide tube 11 to be rotated relative to the screw tube 16.

Next, a type of structure in which the lid recedes to open will be described below with reference to FIGS. 7 to 10. An elongated aperture 102 is formed in a tubular main body 101 so as to extend in the axial direction thereof. A closed inner tube 109 is fitted in the tubular main body 101 so that it can slide therein in the axial direction while an engaging projection 110 formed on the inner tube 109 is projected to the outside of the tubular main body 101 through the elongated aperture 102. A screw tube 114 is rotatably fitted around the tubular main body 101, and the engaging projection of the inner tube 109 is fitted in an inner screw groove 115 so that the inner tube 109 can be lifted as the screw tube 114 rotates in one direction. A tubular member 126 which is fixed to the tubular main body 101, is fitted around the screw tube 114 so that the screw tube 114 can rotate relative to the tubular member 126. A slidable plate 136 is fitted to a longitudinal slide groove 128 formed in the tubular member 126 so that it can move in the axial direction thereof. An engaging projection 138 formed on the slidable plate 136 is fitted in an outer helical slit 121 provided on the outside of the screw tube 114, thereby enabling the slidable plate 136 to move downward as the screw tube 114 rotates in one direction. A lid 142 for closing the opening of the tubular member 126 is pivotally attached to an upper portion of the slidable plate 136. The arrangement is such that as the slidable plate 136 is moved downward, the inner surface of the lid 142 is brought into contact with the upper end of the casing, thereby turning and opening the lid 142. The lid 142 is urged by a spring 143 in the direction of closing movement.

Figure 7:
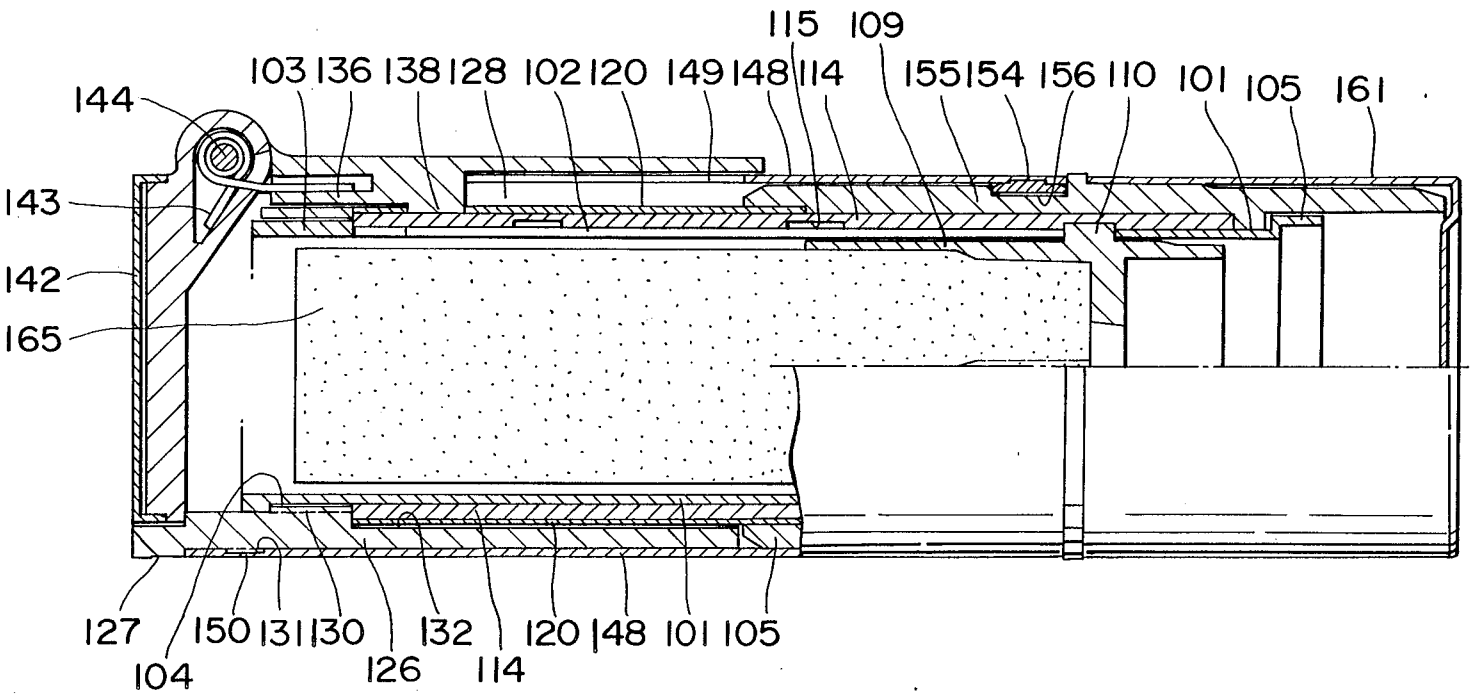
FIGS. 7 to 10 show a second embodiment of the present invention.
Figure 8:
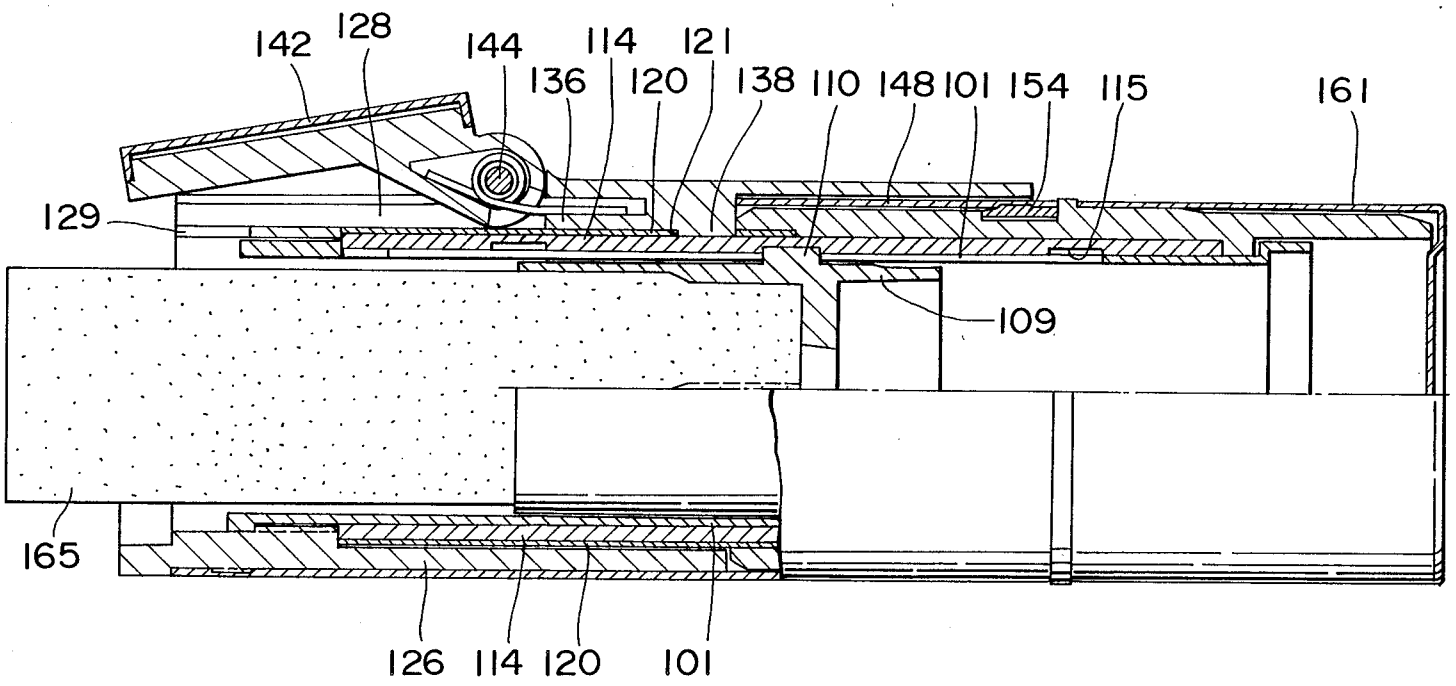
Figure 9:
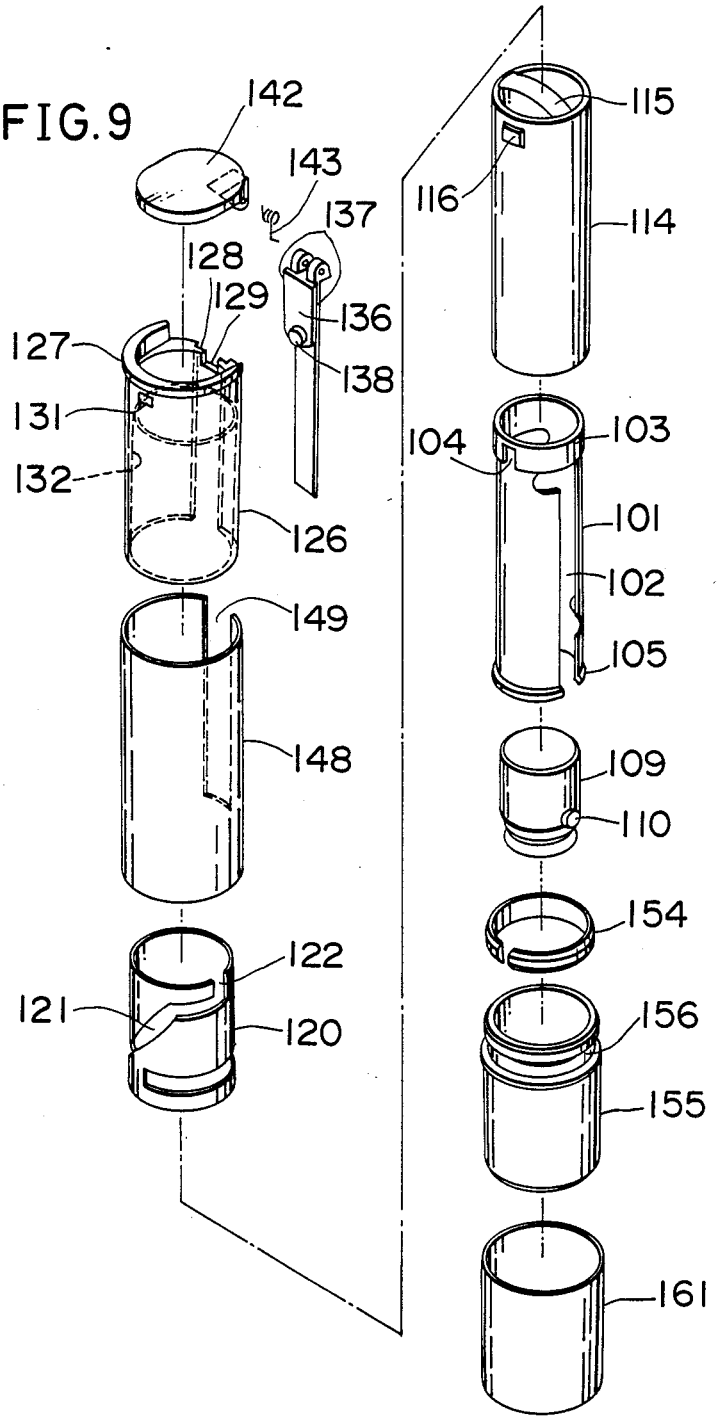
Figure 10:
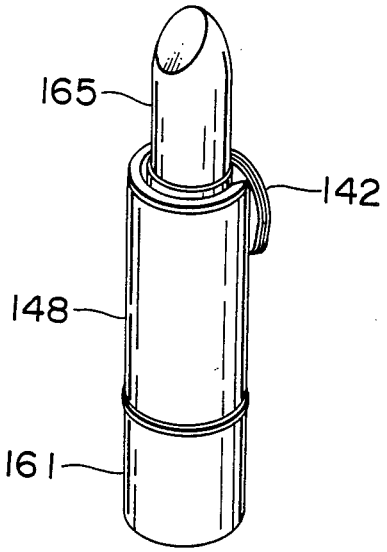
Figure 11:
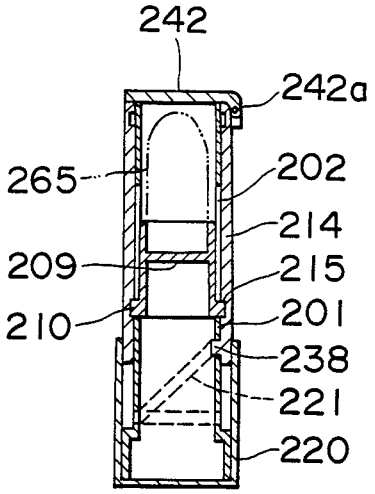
FIG.11 PRIOR ART
FIG. 11 is a cross-sectional view of a cosmetic material casing disclosed in Japanese Utility Model Laid-Open No. 58-88914.
Figure 12:
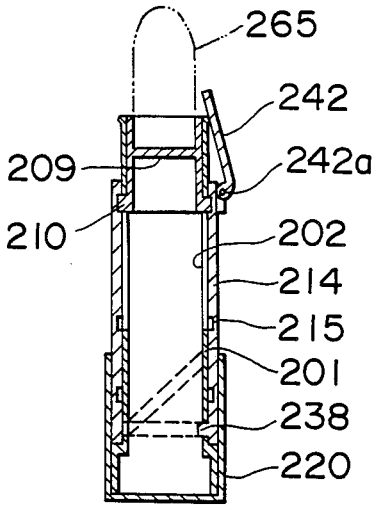
FIG.12 PRIOR ART
FIG. 12 is cross-sectional view of the casing shown in FIG. 11, illustrating a state in which the lid is open.

From the state in which the lid 142 is closed as shown in FIG. 7, the casing is operated to open the lid 142 and protrude the cosmetic material as described below. The screw tube 114 is rotated in one direction while the tubular member 126 is held so as to be stopped from rotating (in the illustrated example, an outer head tube 148 which is formed separately from the tubular member 126 and which is mounted on the outside thereof is held instead of the tubular member 101). In the illustrated example, a skirt tube 155 is fixed on the outside of the screw tube 114, and a lower outer tube 155 is fixed on the outside of the skirt tube 161. The lower outer tube 161 is rotated counterclockwise. In response to this rotation, the slidable plate 136 is moved downward by a force downwardly applied to its engaging projection 138 fitted in the outer helical slit 121. The inner surface of the lid 142 pivotally attached to the upper portion of the slidable plate 136 is thereby brought into contact with the upper end of the casing, namely, the upper end of one of the tubular main body 101, the tubular member 126 and the upper outer tube 148, and the lid 142 is thereafter opened against the urging force of the spring 143.

At the same time, the inner tube 109 having its engaging projection 110 fitted in the inner screw groove 115 of the screw tube 114 is lifted by the cooperation of the inner screw groove 115 and the elongated aperture 102 of the tubular main body 101 as the screw tube 114 rotates in one direction, thereby urging the cosmetic material, out of the tubular member 12 formed as lipstick 165.

Embodiments of the present invention based on the above-described constructions will be described below.

<Embodiment 1>

FIGS. 1 to 6 shows an embodiment in which the casing has the type of structure described in (1).

Figure 2:
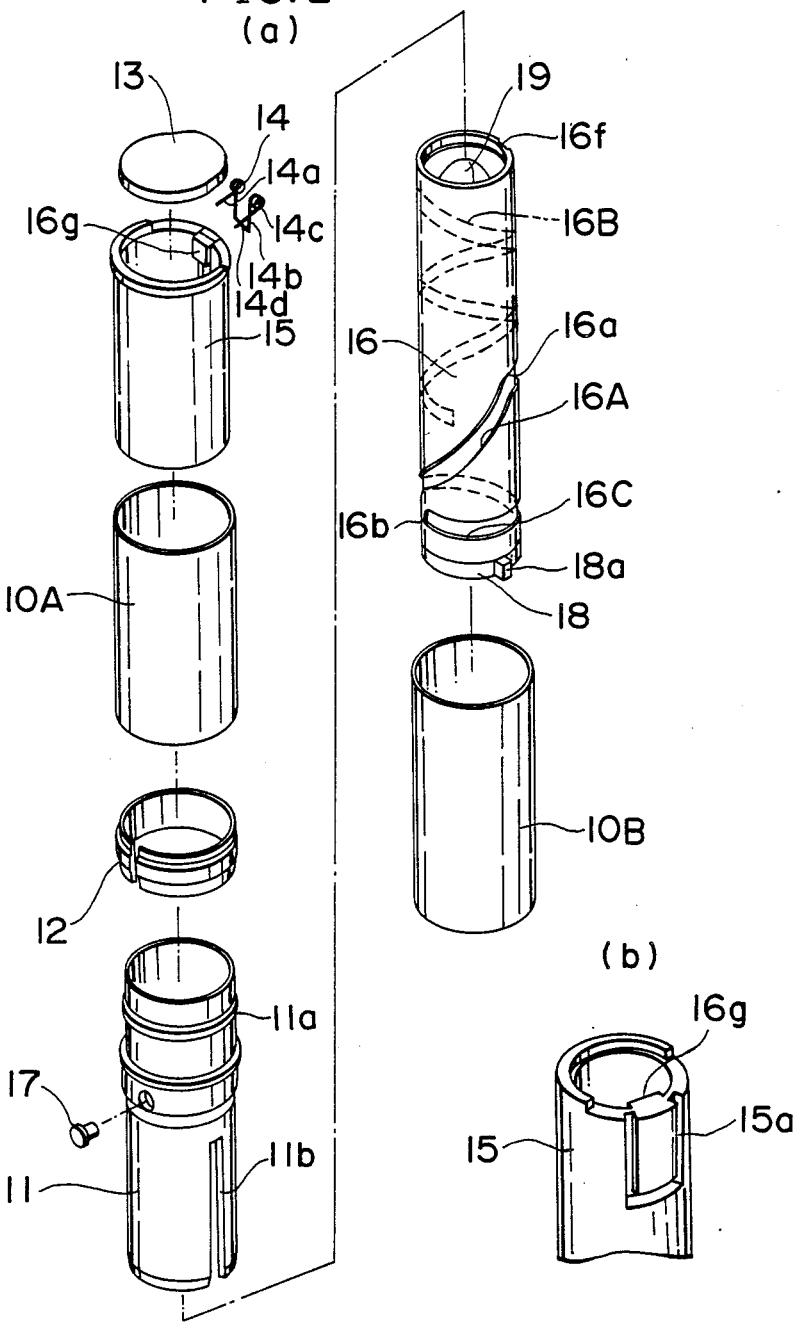
Figure 3:
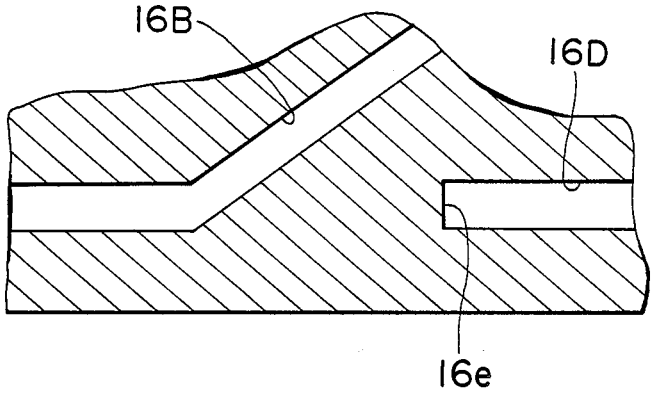

Referring first to FIGS. 1 and 2, the head portion 10A and the rear portion 10B of an outer tube assembly 10 have equal outside diameters and have outer surfaces flush with each other. The head and rear portions 10A and 10B are rotatable relative to each other about the same axis while being interconnected by the guide tube 11 disposed inside the outer tube assembly 10. That is, the outer rear tube 10B closed at its bottom is fitted on and fixed to the outer peripheral surface of the guide tube 11, and the outer head tube 10A is connected by a ring 12 to the guide tube 11 so that it can rotate around the outer peripheral surface of the guide tube 11 while bordering a collar portion **11*a* formed on the guide tube 11. A longitudinal slit 11*b* is formed in the guide tube 11 so as to extend from the base end of the guide tube 11** in the axial direction thereof.

An attachment tube 15 is fitted in the top opening of the outer head tube 10A, and the lid 13 is pivotally attached to the attachment tube 15 while being urged by a pair of torsion coil springs 14 in a direction such that it closes the top opening. One ends **14*a* of the springs 14 are embedded in the lid 13 while the other ends 14*b* are connected to each other and are inserted in a U-shaped attachment recess 15*a* formed in the outer peripheral surface of a top portion of the attachment tube 15. The recess 15*a* is covered with the outer head tube 10A, thereby supporting the pair of springs 14. The coil ends 14*b* themselves have resiliency and inwardly urge the coiled portions 14*c* of the torsion coil springs 14 so that the rear end surface of the lid 13 in the closed state 1 is normally flush with the outer surface of the outer head tube 10A without outwardly protruding therebeyond and that, in this state, the coil portions 14 do not protrude beyond these surfaces. When the lid 13 is opened, the ends 14 of the torsion coil springs 14** are resiliently bent so that the coil portions are displaced outwardly.

The screw tube 16 is fitted on the inner peripheral surface of the guide tube 11 so as that it can slide in the axial direction and can rotate in the circumferential direction. A guide groove 16f is formed in the outer peripheral surface of the screw tube 16 from the top to an intermediate portion of this tube, and a guide projection **16*g* is formed on the inner surface of the attachment tube 15. Consequently, the screw tube 16 can rotate integrally with the outer top tube 10A and can slide in the axial direction inside the attachment tube 15, and, the outer head tube 10A**.

The outer helical groove 16A is formed in the outer peripheral surface of the screw tube 16. As is clear from FIG. 2, the outer helical groove 16A is formed in such a manner that it slantingly extends downwardly from its top end **16*a* or starting end on the side of the top end of the screw tube 16 to a terminal end in the base end portion of the screw tube 16. The outer horizontal groove 16C is formed in the outer peripheral surface of the base end portion of the screw tube 16 so that it extends continuously from the terminal end of the outer screw groove 16A** in the circumferential direction to an extent generally corresponding to one circle.

The first projection piece 17 which is fixed on the guide tube 11 and which inwardly protrudes beyond the inner peripheral surface of the guide tube 11 is engaged with the outer helical groove 16A. As the first projection piece 17 is rotated integrally with the outer rear tube 10B, the screw tube 16 advances through a linear stroke corresponding to the distance between its top end **16*a* and the outer horizontal groove 16C**.

The inner helical groove 16B is formed in the inner peripheral surface of the screw tube 16. The inner helical groove 16B connnects at its end on the side of the base end of the screw tube 16 to the inner horizontal groove (FIG. 3) 16D which is formed in the inner peripheral surface of the base end portion of the screw tube 16 and which extends in the circumferential direction to an extent generally corresponding to one circle.

Figure 4:
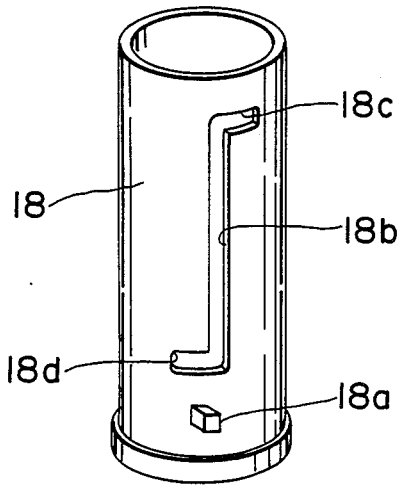

The holder guide tube 18 is rotatably fitted on the inner periphery of the screw tube 1. The holder guide tube 18 has a guide lug **18*a* projecting from its bottom portion. The guide lug 18*a* is engaged with the longitudinal slit 11*b* of the guide tube 11 so as to guide the movement in the axial direction of the holder 18 and enables the holder 18 to be rotated integrally with the guide tube 11 and the outer rear tube 10B. The holder guide tube 18 is stopped from sliding in the axial direction of the screw tube 16 by the engagement of engaging pawls 18*e* and 18*f*. The longitudinal slit 18*b* is formed in the peripheral wall of the holder guide tube 18. Horizontal slits 18*c* and 18*d* are formed at the top and base ends of the longitudinal slit 18*b*, respectively, as shown in FIG. 4. The sum of the length of horizontal slits 18*c* or 18*d* and the length of the outer horizontal groove 16C or the inner horizontal groove 16D corresponds to the circumference of the screw tube 16** on the outer peripheral surface or the inner peripheral surface thereof.

The holder 20 which retains a stick of cosmetic material 19 is fitted on the inner peripheral surface of the holder guide tube 18 so that it can move in the axial direction. The second projection 21 protrusively formed on the outer peripheral surface of the holder 20 is brought into engagement with the inner helical groove 16B of the screw tube 16 through the longitudinal slit **18*b* of the holder guide tube 18**.

Next, the operation and effect of this embodiment will be described below.

In an initial state shown in FIG. 1, the first projection piece 17 is located at the starting end of the outer helical groove 16A of the screw tube 16 while the second projection 21 of the holder 20 is in contact with a terminal edge **16*e* of the inner horizontal groove 16D by passing through the horizontal slit 18*d***.

Figure 5:
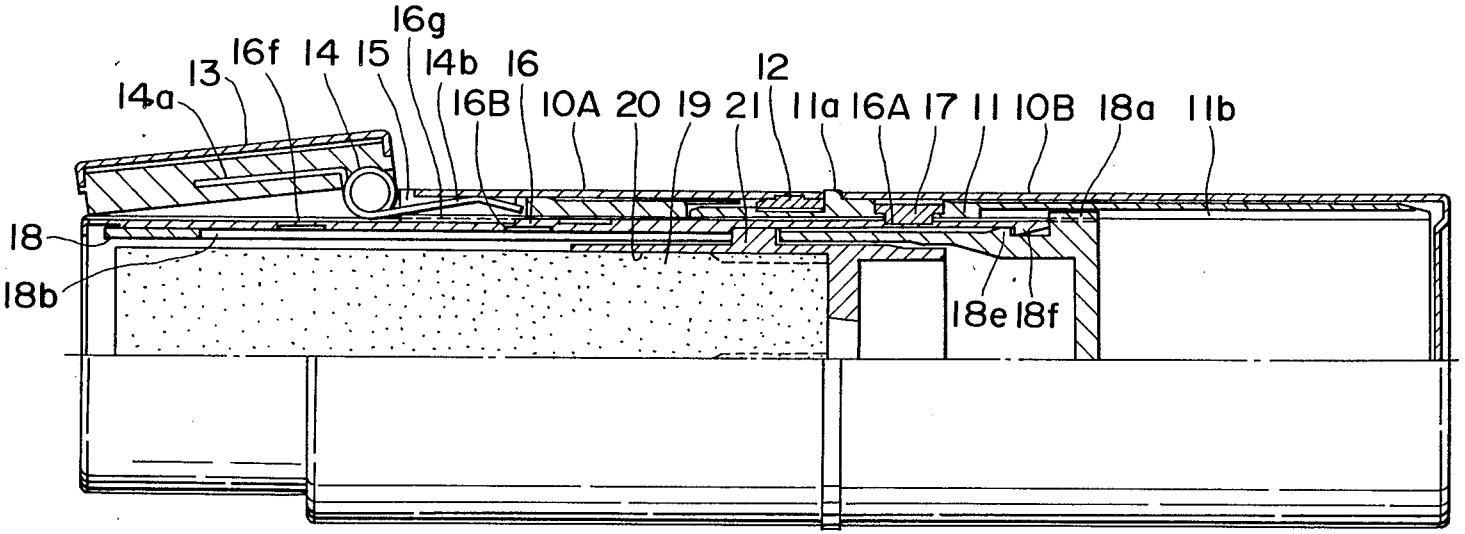

As shown in FIG. 5, as the outer rear tube 1OB is rotated in an initial stage while the outer head tube 10A is held fixedly, the outer rear tube 10B, the guide tube 11, the holder guide tube 18 and the holder 20 are integrally rotated relative to the screw tube 16 integrally connected to the outer head tube 10A by the attachment tube 15. The first projection piece 17 is thereby moved downwardly in the outer helical groove 16A of the screw tube 16 from the top end **16*a* along the sloping surface. Relative to this movement, the screw tube 16 advances toward the left of FIG. 5 to a predetermined extent in the guide tube 11 and in the outer head tube 10*a***.

During this forward movement of the screw tube 16, the top end of the screw tube 16 comes into contact with the ends **14*b* of the torsion coil springs 14 from below so as to bend and displace the same. The coiled portions 14*c* of the torsion coil springs 14 thereby escape outward, and the lid 13 is opened by being moved upward against the force of the torsion coil springs 14. At the same time, the holder guide tube 18 and the holder 20 also advance through the same distance by following the screw tube 16**.

During this operation, the second projection 21 of the holder 20 moves in the inner horizontal groove 16D formed in the inner surface of the screw tube 16 to the starting end of the inner helical groove 16B, exits out of the horizontal slit **18*d* and reaches the base end of the longitudinal slit 18*b***.

Figure 6:
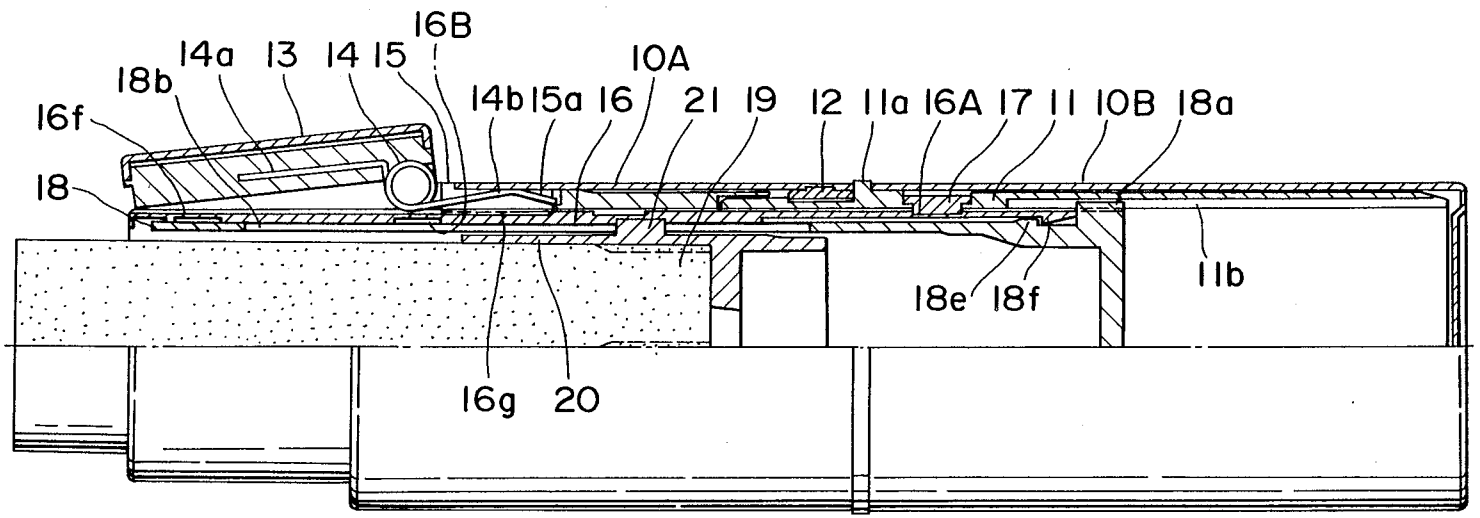

As shown in FIG. 6, to perform the operation of protruding the cosmetic material 19, the outer rear tube 10B is rotated in the sate where the lid 13 has been opened by the initial rotation of the outer rear tube 10B, thereby integrally rotating the guide tube 11 and the holder guide tube 18 relative to the screw tube 16. This rotation applies an upward force to the second projection 21 of the holder in engagement with the inner helical groove 16B, and the second projection 21 is thereby lifted while being guided along the longitudinal slit **18*b* of the holder guide tube 18 so that the holder is further moved from the advanced position, thereby urging the cosmetic material 19 out of the holder guide tube 18**.

During this operation, the first projection piece 17 exits out of the terminal end of the outer helical groove 16A and then moves in the outer horizontal groove 16C, thereby allowing the guide tube 11 to rotate relative to the screw tube 16. After the first projection piece 17 has come into contact with a terminal edge **16*e* of the outer horizontal groove 16C, the second projection 18*a* of the holder guide tube 18 which has reached the top end of the longitudinal slit 18*b* enters the horizontal slit 18*c***.

The operation of retracting the cosmetic material 19 is performed in accordance with the procedure reverse to the above.

As described above, the overall outside configuration of the cosmetic material casing constituted by the outer head tube 10A, the outer rear tube 10B and the lid 13 in accordance with the present invention is simple and the outside surfaces thereof are formed without any protrusions. Thus, the casing of the present invention is improved in the appearance and form to satisfy requirements for cosmetic casings.

The above-described structure enables the protruding operation to be smoothly performed and enables the lid 13 to be automatically opened or closed in a linked relationship with the operation of advancing or retracting the cosmetic material 19 or the lipstick, thus making the casing convenient.

<Embodiment 2>

In this embodiment, the casing has the type of structure described in (2).

The tubular main body 101 has an upper annular projection 103 and a lower annular projection 105. An engagement recess 104 is formed in the upper annular projection 103. A pair of elongated apertures 102 are formed in the cylindrical portion of the tubular main body 101. Each elongated aperture 102 has left and right horizontal extensions formed at its upper and lower portions.

The inner closed tube 109 is fitted in the tubular main body 101 so that it can slide in the axial direction while engaging projections 110 formed on the inner tube 109 project to the outside of the tubular main body 101 through the elongated apertures 102 so as to inhibit the inner tube 109 from rotating.

The screw tube 114 is rotatably fitted around the tubular main body 101. The screw tube 114 has an engaging protrusion 116 formed on its outer surface and a pair of inner screw grooves 115 which are formed in its inner surface and in which the engaging projections 110 of the inner tube 109 are fitted. The arrangement is such that as the screw tube 114 is rotated in one direction, the engaging projections 110 of the inner tube 109 are moved upward by the inner screw grooves 115 and the elongated apertures 102 so that the inner tube 109 is lifted. An outer screw tube 120 in which the outer helical slit 121 is formed is fitted around a head portion of the screw tube 114, and the engaging protrusion 116 of the screw tube 114 is fitted in a longitudinal slit 122 of the outer screw tube 120, thereby inhibiting the outer screw tube 120 from rotating relative to the screw tube 114.

The tubular member 126 is fitted around the screw tube 114 so that it can rotate relative to the tubular member 126. The tubular member 126 is fixed on the tubular main body 101 by engaging its inner engaging protrusion 130 formed on its inner surface with the engagement recess 104 of the tubular main body 101. The tubular member 126 has an upper annular projection 127, an outer fitting protrusion 131, an end cutout 129 and a screw tube fitting portion 132 formed over its inner surface except for an upper portion. The tubular member 126 also has the longitudinal slide groove 128 formed on the outside of the end cutout 129. The longitudinal slide groove 128 are formed as an aperture over the area facing the screw tube fitting portion 132.

Side portions 137 of the slidable plate 136 are fitted in the slide groove 128 of the tubular member 126 so that they can slide in the axial direction of the tubular member 126. The engaging projection 138 of the slidable plate 136 is inserted into the tubular member 126 through the aperture of the tubular member 126 and is fitted in the outer helical slit 121 of the outer screw tube 120. The arrangement is such that, as the screw tube 114 is rotated in one direction, the outer helical slit 121 applies a downward force to the engaging projection 138 of the slidable plate 136, thereby moving the slidable plate 136 downward.

The outer head tube 148 is fitted around the tubular member 126; a fitting recess 150 formed in the outer head tube 148 is fitted to the outer fitting protrusion 131 of the tubular member 126; and portions of the upper head tube 148 on opposite sides of a longitudinal slit 149 formed therein restrain an outer portion of the slidable plate 136.

The lid 142 for closing the top opening of the tubular member 126 is pivotally attached by a shaft 144 to the upper portion of the slidable plate 136. The lid 142 is capable of opening by contacting the upper end of the casing, namely, the upper end of one of the tubular main body 101, the tubular member 126 and the outer head tube 148 when the slidable plate 136 is moved downward. The lid 142 is urged in the closing direction by the spring 143.

The skirt tube 155 is interposed between the screw tube 114 and the outer head tube 148. The skirt tube 155 is fittingly mounted so that both the rotation and the longitudinal sliding of the skirt tube relative to the screw tube 114 and the outer screw tube 120 are inhibited. A ring 154 is fitted in an annular recess 156 formed in the skirt tube 155. The skirt tube 155 can be rotated relative to the outer head tube 148 with the ring 154 interposed therebetween.

The lower outer tube 161 closed at its bottom is non-rotatably fitted around a portion of the skirt tube 155. The lipstick 165 is inserted in the inner tube 109.

In this embodiment, the screw tube 114 and the outer screw tube 120 are formed separately from each other. However, the screw tube 114 and the outer screw tube 120 may be formed integrally. The need for the outer head tube 148 may be eliminated if the longitudinal slide groove 128 of the tubular member is formed as a dovetail groove so as to prevent the slidable plate 136 from coming off, or if the longitudinal slide groove 128 is formed inside the tubular member 126.

Each of the skirt tube 155, the ring 154 and the lower outer tube 161 is not always necessary. Any other types of construction are possible so long as the screw tube 114 can be rotated relative to the tubular member 126.

In this embodiment, the inner screw groove 115 is formed in the screw tube 114, the outer helical slit 121 is formed on the outside of the screw tube 114, the slidable plate 136 is moved downward by the outer helical slit 121 to open the lid 142, and the inner tube 109 is moved upward by the inner screw groove 115, thereby enabling a reduction in the void formed at the bottom of the casing. The arrangement of moving the lid 142 downward with the slidable plate 136 ensures that the tubular main body 101 or any other members do not protrude beyond the top end of the tubular member 126 when the lid 142 is opened and the cosmetic material is protruded, thus improving the appearance of the casing.

What is claimed is:

1. A cosmetic casing capable of causing a cosmetic material to protrude therefrom, comprising:

a tubular main body having an elongated aperture extending in the axial direction;

a closed inner tube fitted in said tubular main body and axially slidable therein, said inner tube having a first projection projecting to the outside of said tubular main body through said elongated aperture;

a screw tube rotatably fitted about said tubular main body, said screw tube having an inner screw groove in which said first projection of said inner tube is fitted, whereby said inner tube is moved as said screw tube rotates relative to the main body;

a tubular member fitted around said screw tube and fixed to said tubular main body;

a lid for closing an opening at one end of said casing; spring biasing means for urging said lid toward a closed position;

a slidable plate, a longitudinal slide groove formed in said tubular member, means for slidably mounting the plate in the slide groove, whereby the plate slides in the axial direction of said tubular member, a second projection formed on said slidable plate, an outer helical slit provided on the outside of said screw tube, the second projection engaging the outer helical slit whereby said slidable plate is moved axially in a direction opposite the inner tube as said screw tube rotates relative to the main body, means for pivotally mounting said lid on said slidable plate whereby, when said inner tube is moved toward the opening of said tubular member by the rotation of said screw tube relative to the main body, said lid is moved to an opening position by the axial movement of said slidable plate as the lid engages an end portion of said casing.

* * * * *